United States Patent [19]

Mankowski

[11] Patent Number: 5,050,489

[45] Date of Patent: Sep. 24, 1991

[54] ROOF VENTILATOR

[76] Inventor: John P. Mankowski, 70 Boston Blvd. W., Detroit, Mich. 48202

[21] Appl. No.: 538,564

[22] Filed: Jun. 15, 1990

[51] Int. Cl.[5] ..... F24F 7/02

[52] U.S. Cl. ..... 98/42.21; 98/42.22

[58] Field of Search ..... 98/42.21, 42.22; 52/199

[56] References Cited

U.S. PATENT DOCUMENTS

| | | | |
|---|---|---|---|
| 2,423,739 | 7/1947 | Tillman | 98/42.21 |
| 2,799,214 | 7/1957 | Rouse | 98/42.21 |
| 3,311,047 | 3/1967 | Smith et al. | 98/42.21 |
| 3,625,134 | 12/1971 | Smith | 98/42.21 |
| 4,558,637 | 12/1985 | Mason | 98/42.21 |

FOREIGN PATENT DOCUMENTS

| | | | |
|---|---|---|---|
| 2707384 | 8/1978 | Fed. Rep. of Germany | 52/199 |
| 44537 | 3/1984 | Japan | 98/42.21 |
| 84/02970 | 8/1984 | PCT Int'l Appl. | 52/199 |

*Primary Examiner*—Harold Joyce

*Attorney, Agent, or Firm*—Lynn E. Cargill

[57] ABSTRACT

A roof ventilator (10) comprises a contoured, substantially rounded cover member (12) including a nailing tab and flange configuration to allow use of the ventilator on roofs and roof ridges of different angles and pitches. A vent (14) is located in the cover member (12), and the vent has openings (16) to permit air circulation through the roof or roof ridge, and includes weepage openings (24) at the bottom of the vent to permit any collected liquids to drain therethrough. The shape of the vent is designed to deflect air flow over the roof ventilator, thereby substantially preventing foreign particle entry through the roof ventilator into the building.

30 Claims, 4 Drawing Sheets

12
14
16
20
21
26
28
30
32
34
36
38
39
40
42
44
50
52
54
56
58
60
62
64
66

FIG 5A
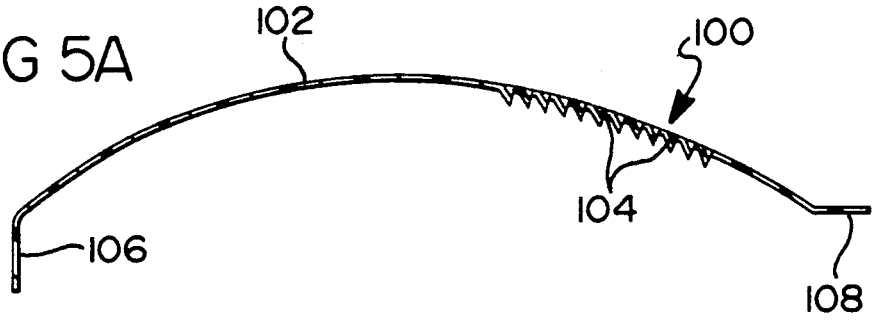
FIG 5B
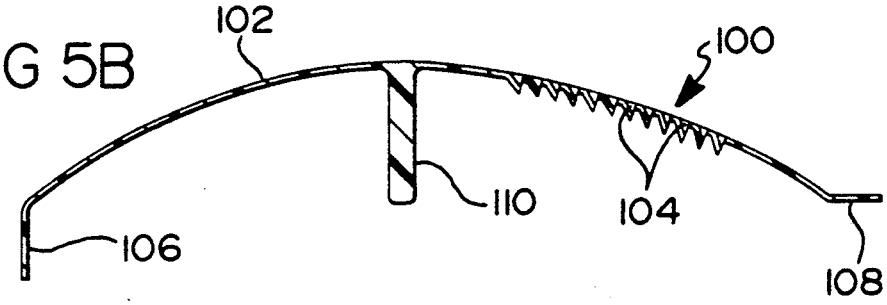
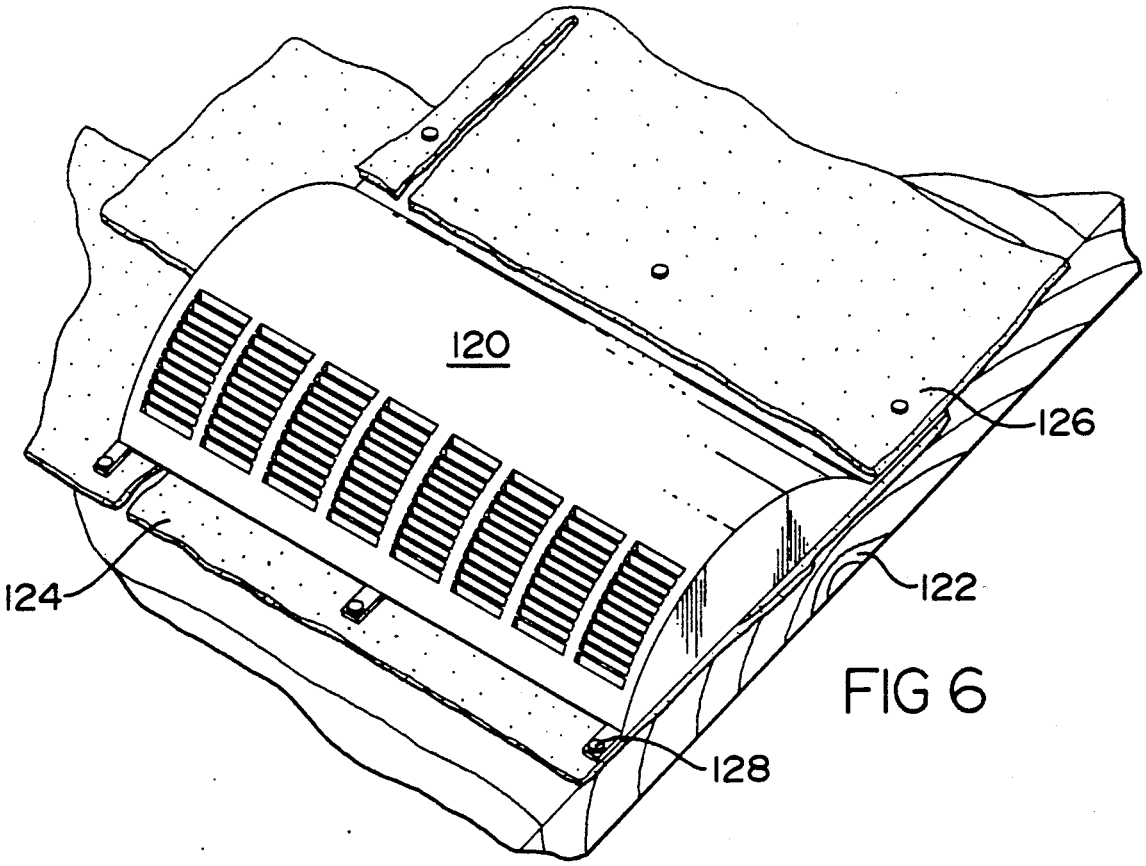
FIG 6

ROOF VENTILATOR

This invention relates to a roof ventilator.

BACKGROUND OF THE INVENTION

As air flows over a roof, the air attaches to the roof, and follows the contour of the roof up the incline, over the peak, and follows the contour of the roof on the other side. If the pitch of the roof is a standard 15 to 20 degree pitch, the wind attaches to the roof and climbs due to its own force over the building. Two factors contribute to the ventilation of a building: (1) the static pressure from within the building and (2) the outside wind pressure caused by wind flowing over the building. The static pressure is generally due to temperature differences between the floors, infiltration, air leakage, the building envelope heating and cooling, and heat generated by appliances, causing air to flow up through the roof of the building. The wind pressure is caused by the wind flowing over the building. The direction of the prevailing wind and the placement of the building dictate the need for ventilation. The amount of contact area of the roof with the wind also contributes.

A positive pressure area is created when the wind hits the roof and the building, while a negative pressure area is created on the opposite side. Within the negative pressure area, there is an area known as $Z_0$, or the dead zone which is located just on the other side of the peak of the roof from the positive pressure area. Further down the roof is area $Z_1$, or the recirculation area, which is adjacent the dead zone. Further down the opposite side of the roof from the direction in which the wind is hitting is area $Z_2$, or the high turbulence zone. And yet even further down the roof line opposite the side being struck by the wind is area $Z_3$, or the wake zone.

In order to most advantageously utilize the function of a roof ventilator, the goal is to place an inlet in the most positive pressure area, i.e. in the soffit next to the overhang, and on the face of the building which has air striking against it and being repelled away from it due to the high pressure occurring there. The next highest positive pressure zone is the area of the roof which is being struck by the wind, with a decreasing pressure as the wind flows up over the peak of the roof. For optimum use of a ventilator, an outlet should be located in the most negative pressure area. In the dead zone, the air has nearly zero velocity, with the velocity increasing as you go down the roof line on the opposite side from that face which is experiencing the wind.

Ideally, a ventilator will augment the static pressure and direct the wind flow without creating wind turbulence. Therefore, the vent should be located in the dead zone or in the recirculation region for maximum efficiency. Placing the vent in the dead zone also avoids infiltration because the substantially zero velocity of the air will not force any foreign matter back into the vent as the air is not moving in that region. In order to control infiltration, one must control the air around the placement of the vent.

It can be seen, therefore, that a single side leeway vent may be the most advantageous type of vent. Because vents cannot be customized for individual homes due to cost restraints, a vent should be designed for the average home, taking into consideration the direction of the prevailing wind in that area.

Roof ventilators permit circulation of hot air through the roof of a building to decrease the temperature within the building and to allow for air circulation under the roof, especially desirable for the removal of moisture build-up to prevent rotting of wooden members. Conventionally, roof ventilators have been unsightly, and have further served as nesting places for birds, insects and the like.

Some of the problems with previous roof ventilators have included a projecting height which is too great, multi-piece constructions which are difficult to install, roof ventilators which are unable to adapt to various roof pitches, thereby requiring a multitude of products for different building types and roof ventilators which are generally unsightly.

Furthermore, it has been found that roof ventilators must be of a sturdy construction to withstand pressures of shipping and handling, to avoid being easily damaged. Other considerations for shipping and handling include the ability of a design to provide a compact ventilator, one that can be shipped in a flat position, and one that can be stored in inclement weather conditions. The design of a roof ventilator must also include ways to improve aesthetics, propensity of air volume circulation, resistance to deterioration, ability to withstand exposure to high winds and other inclement weather conditions, along with its ability to prevent dirt, rain and insects from entering into the attic space being ventilated.

Previous inventions have included roof ridge ventilators which are placed on top of the shingles, such as U.S. Pat. No. 3,481,263 issued to M. C. Belden on Dec. 2, 1966 and U.S. Pat. No. 3,303,773 issued to L. L. Smith, et al., on Feb. 14, 1967. More recent inventions include roof ridge ventilators which are placed underneath cap shingles, for example, U.S. Pat. No. 3,236,170 issued to Meyer, et al., U.S. Pat. No. 4,280,399 issued to Joseph M. Cunning and U.S. Pat. No. 4,676,147 issued to the present inventor, John P. Mankowski.

U.S. Pat. No. 4,817,506 to Cashman discloses a ventilator having vertical struts to provide structural support. He further disclosed non-louver slit openings to permit air flow therethrough. However, the Cashman invention includes so many vertical struts that the net free area is greatly reduced, thereby impeding and restricting air flow by creating maximum restriction areas. The present invention achieves an even greater net free area by providing a roof ventilator having a sufficient structural static load bearing capability without the need for the vertical struts which so greatly reduce the net free area.

An object of the present invention is to provide an improved roof ventilator having particular utility in the construction of residential and commercial buildings.

Another object of the present invention is to provide an improved roof ventilator which will exhibit superior performance regardless of the orientation of the building.

Yet another object of the present invention is to direct air flow so as to reduce the velocity of the air flowing therethrough such as to limit entry of foreign particles through the roof into the ventilated space below.

It is yet still another object of the present invention to provide a roof ventilator which can easily be manufactured and easily installed.

The objects, features, and advantages of the present invention are readily apparent from the following detailed description of the best mode for carrying out the invention when taken in connection with the accompanying drawings.

DISCLOSURE OF INVENTION

In order to meet these objects, the present invention discloses an improved roof ventilator which includes a contoured, substantially rounded cover member including a vent therein with a plurality of louvered openings designed for placement on the leeward side of a pitched roof. The roof ventilator is intended to be attached in the recirculation region or the dead zone on the roof. It is preferably roll formed or stamped aluminum or other metal, but may also be injection molded or extruded plastic. The cover member includes a plurality of nailing tabs and a continuous nailing flange to receive various fastening means for securing the ventilator to the roof. Weepage openings are included on the downwardly facing bottom portion of the ventilator and may also include struts for support. The ventilator may be formed of a singular piece that is folded backward and inward to form the interior vent. At least one vent having wall supports may be included to act as an infiltration barrier and for structural support. Generally, the preferred embodiment includes two vent walls with louvered openings for deflecting the air flow as it passes therethrough to reduce the velocity of the air, thereby substantially preventing foreign matter from being forced back down into the building. Generally, the vent is an inverted V-shaped configuration, with the peak of the inverted V being adjacent to or connected to the bottom of the contoured cover member. The interior vent may be attached to the underside of the cover member to supply rigidity and additional load capabilities. A foot may be attached to the interior vent to conform more to the roof face. Furthermore, an air foil may be mounted in such a way as to further throw the air over the vent to increase the areas of recirculation and to create a calm air region around the vent, thereby lowering the turbulence around the vent.

Other embodiments are envisioned which may include the manufacture of the vent without an interior vent portion, with or without a structural strut support, or it may include the interior vent having a regular V-shaped configuration, with the bottom of the V shaping downwardly, rather than upwardly as in the above embodiment. It may be also seen from the ensuing description and drawings that the ventilator may be used at the roof ridge, or it may be used as a roof ventilator placed in a lower portion of the roof to give additional ventilation.

In accordance with the present invention, an improved roof ventilator is provided having increased air flow due to proper air direction through the ventilator. Rain, insects and dirt particles are prevented from entering the ventilated space while retaining compact size, low cost, ease of manufacture, ease of installation, sturdiness, and longevity. Essentially, the present roof ventilator may either be used as a singular ventilator to be installed in the lower portion of the roof or as a roof ridge ventilator including a pair of vents adapted to extend longitudinally on a roof ridge covering the peak of the roof ridge. The single roof ventilator is installed by cutting a slot in the roof, in the area of the roof over which the roof ventilator is being installed, and nails or other fastening means are directed through the ventilator to secure it to the roof. The roof ridge ventilator is placed into position by merely laying the ventilator over the peak of the roof, and nailing through the ventilator into the materials below.

BRIEF DESCRIPTION OF THE DRAWINGS

The nature and extent of the present invention will be clear from the following detailed description of the particular embodiments thereof, taken in conjunction with the appendant drawings, in which:

FIG. 5*a* is a side view of a singular vent without the interior vent portion, and without a vertical support strut;

FIG. 5*b* shows a similar vent to the one shown in FIG. 5*a,* but with the addition of a vertical support strut; and FIG. 6 shows a roof ventilator constructed in accordance with the present invention as installed on a roof to show relative placement of the vent and the shingles.

DETAILED DESCRIPTION OF THE DRAWINGS

Figure 1:
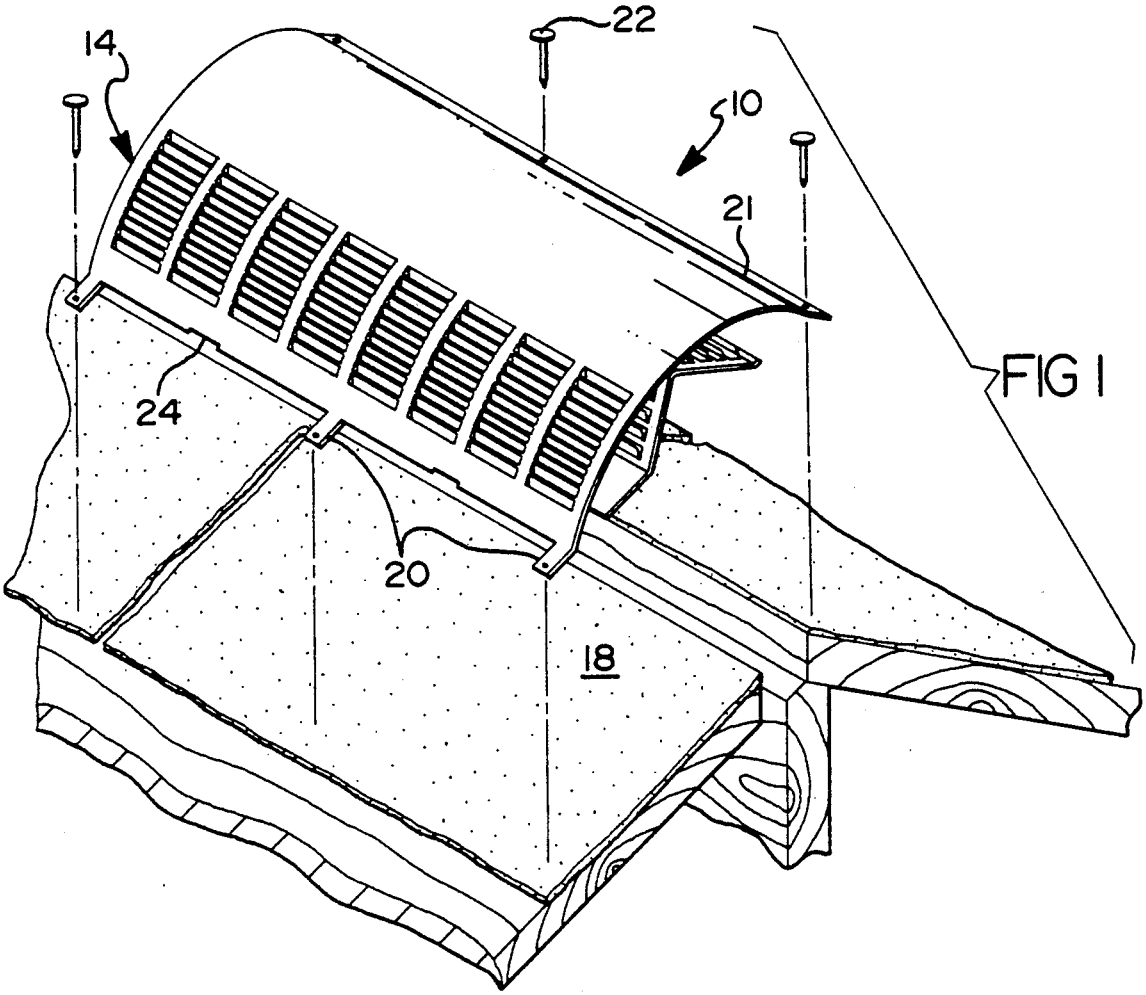
FIG. 1 is a perspective view of a roof ventilator constructed in accordance with the present invention shown as installed on the leeward side of a roof.

With reference to FIG. 1 of the drawings, a roof ridge ventilator constructed in accordance with the present invention is generally indicated by reference number 10, having particular utility in the construction of residential and commercial buildings. Roof ridge ventilator 10 includes a one-piece contoured, substantially rounded cover member 12 of an elongated shape including a vent 14 having a plurality of openings 16 therein. Openings 16 are preferably of a shielded louver design although they may be constructed as slits or other types of openings. Roof ventilator 10 is placed over shingles 18 and secured to the roof by nailing tabs 20 and nailing flange 21 by fastening means 22, such as nails or rivets. Weepage openings 24 allow any collected liquids to flow therethrough so that liquids will not collect underneath the vent. Nailing tabs 20 and nailing flange 21 may be of any possible configuration as may be known to one of ordinary skill in the art, although the preferred configuration is shown in FIG. 1. Nailing flange 21 is relatively flexible and is nailed onto the windward side of the peak, while the rest of the ventilator rests on the leeward side of the roof. Placement of vent 10 onto the leeward side of the roof puts the vent in the dead zone, or the recirculation region of the roof, and therefore places the vent in a place of low velocity, lowering the turbulence around the vent and minimizing the infiltration of foreign matter through the vent.

Figure 2:
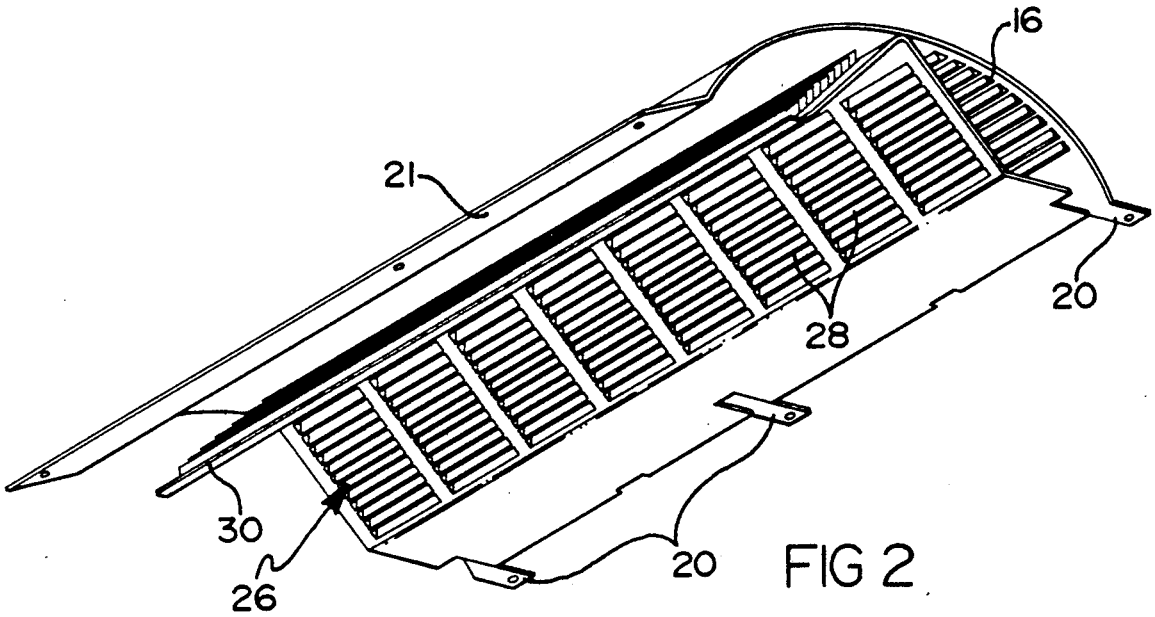
FIG. 2 is a bottom perspective view of an assembled roof ventilator illustrating the preferred embodiment.

As can be seen in FIG. 2, the interior or inner vent 26 also includes louvered openings 28. Again, as described hereinabove, louvered openings 28 may be of any other convenient configuration, such as slits or perforations in order to be useful. The louvered opening configuration shown in FIG. 2 is the most preferred. The interior vent 26 has an inverted V-shaped configuration for maximum structural support, and includes a foot 30 on the bottom of interior vent 26 for conforming to any roof pitch. Because interior vent 26 is somewhat flexible, foot 30 rides on top of the underlying shingles as shown in FIG. 1 for proper placement.

Figures 3A, 3B, 3C, 3D, 3E:
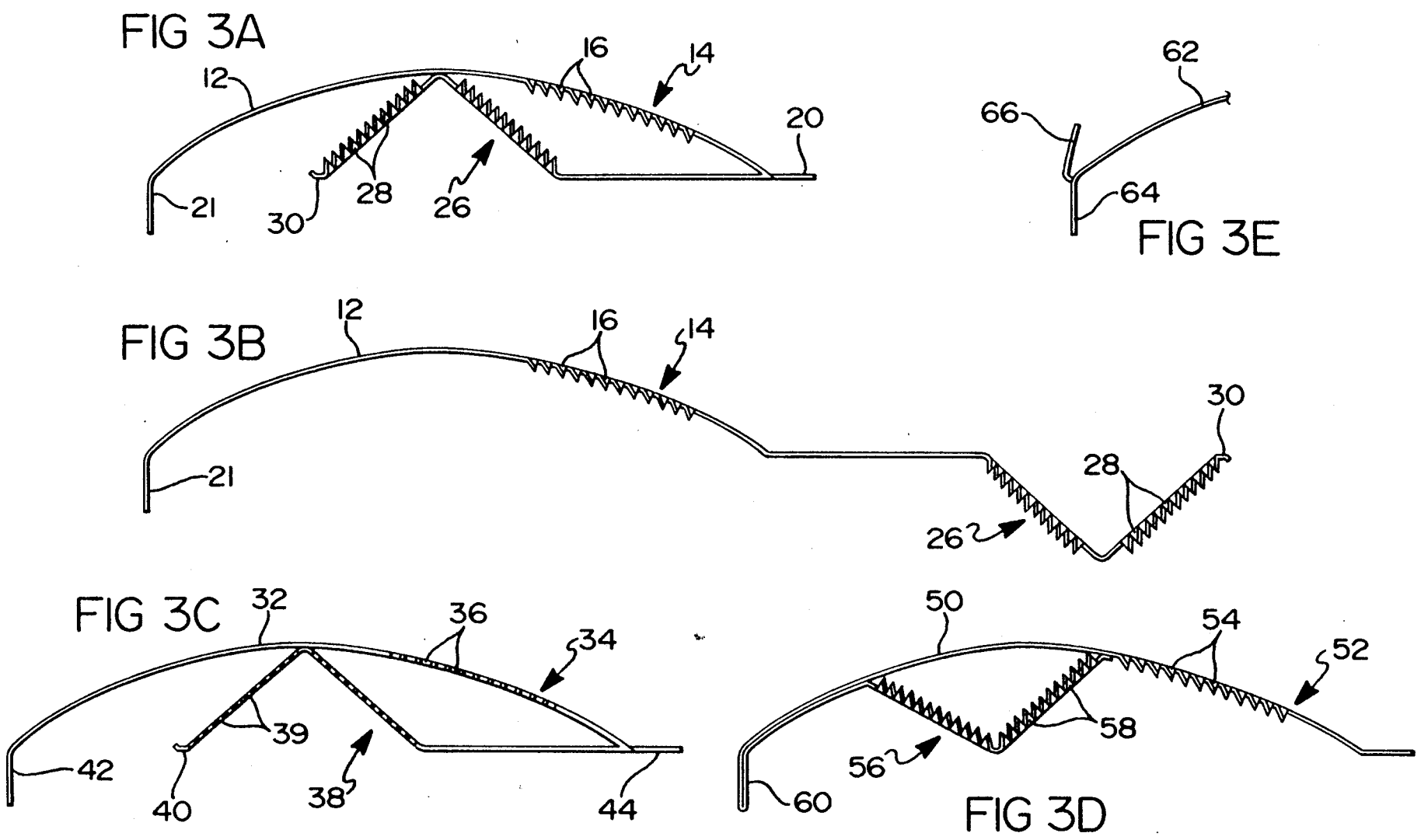
FIG. 3*a* illustrates an assembled version of a one-piece preferred embodiment of the invention.
FIG. 3*b* shows an unassembled ventilator which is then bent into the shape of FIG. 3*a;*
FIG. 3*c* illustrates another embodiment of the invention similar to FIG. 3*a,* but with openings instead of louvers.
FIG. 3*d* illustrates yet another embodiment of the invention, with a V-shaped configuration for the vent, rather than the inverted V-shaped configuration.
FIG. 3*e* shows the placement of the air foil next to the nailing flange as discussed below.

Turning now to FIGS. 3*a* through 3*e*, FIG. 3*a* is a side view of the vent as shown in FIG. 1. Contoured cover member 12 includes a vent 14 with openings 16 therein. The nailing flange 21 is shown in a drop position, but may be formed in any desired configuration. Nailing tabs 20 are shown extending from the contoured cover member 12 and the entire configuration is shown in an assembled form. FIG. 3*b* shows the vent as it is originally manufactured before bending into the configuration of 3*a*. The inner vent 26 is preferably formed in a V-shaped configuration with openings 28, and when bent back inward underneath cover member 12, the inner vent 26 forms an inverted V-shape.

FIG. 3*c* shows another embodiment of the vent with a contoured cover member 32 having a vent 34 with openings 36 which are not louvered openings. Openings 36 and 39 may be of any other configuration which will deflect the air flow, such as slits or perforations. Nailing flange 42 is again shown in a dropped position, but may be formed into any desired configuration for the application. The inner vent 38 including openings 39 also shows a foot 40 for resting on top of shingles. FIG. 3*c* is shown in an inverted V-shaped configuration, although it may be formed into a V-shaped configuration as the embodiment shown in FIG. 3*d*.

FIG. 3*d* illustrates yet another embodiment of the present invention in which the ventilator may be formed into a one-piece assembly, but the portion which is bent back under cover member 50 is formed in a different configuration than that shown in FIG. 3*b*. The nailing flange 60 may be the point of bending. Contour cover member 50 includes a vent 52 with openings 54, preferably of the louvered configuration shown in FIG. 3*d*. As before, this vent may include other types of openings rather than the louvered design. The inner vent 56 is shown in a V-shaped configuration with louvered openings 58 therein.

Figure 4A:
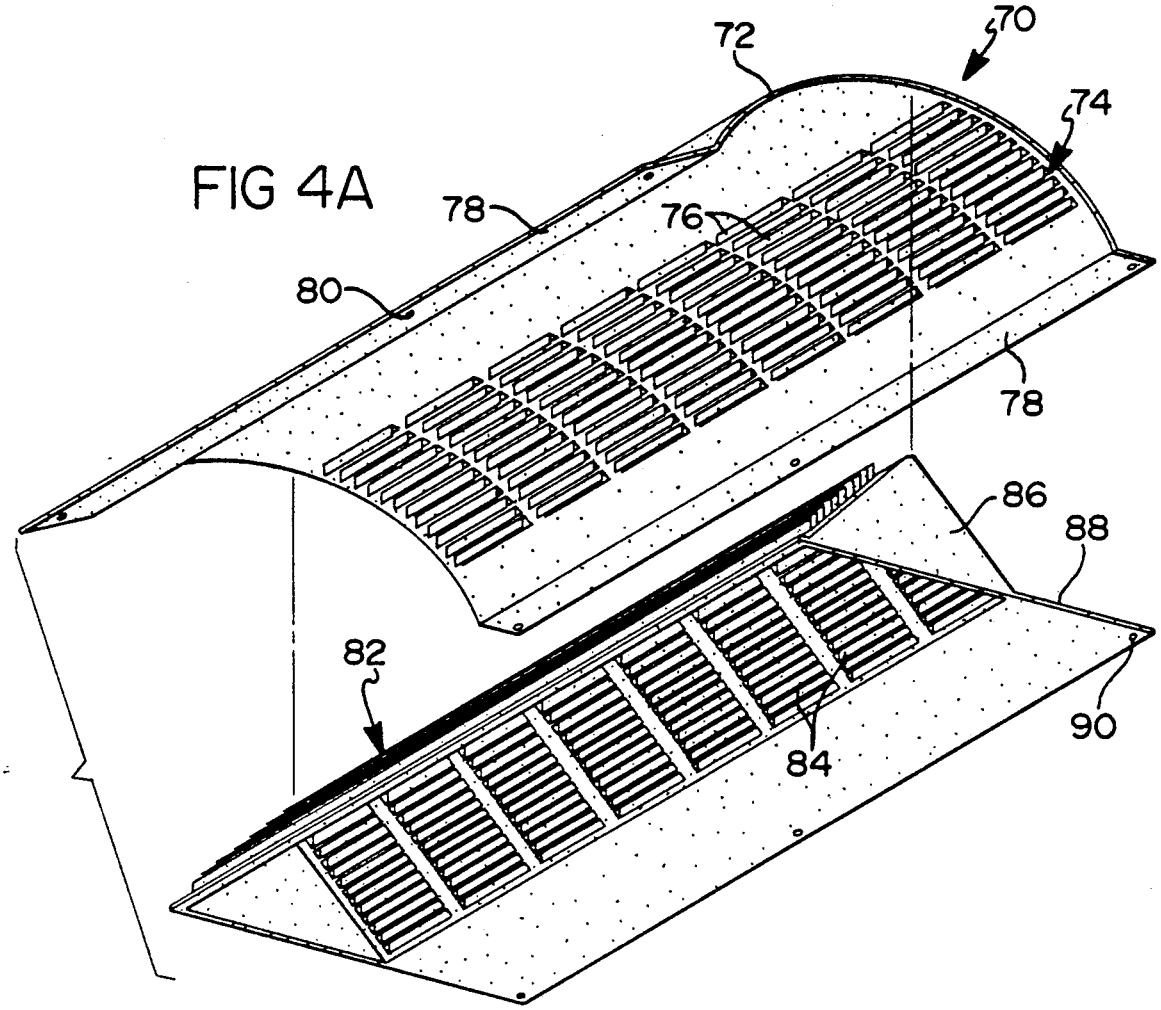
FIG. 4*a* shows an exploded two-piece assembly with vertical structural support struts.
Figure 4B:
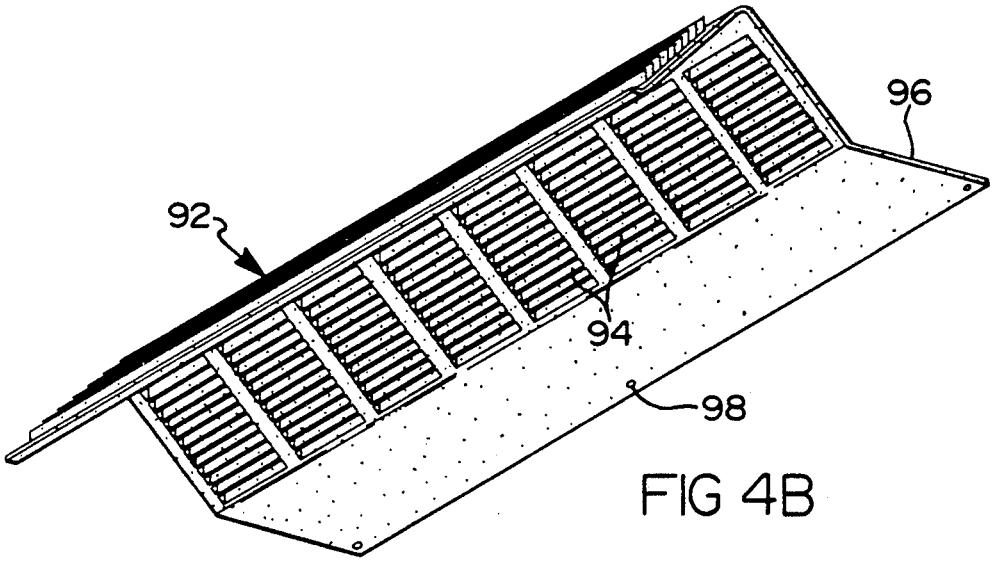
FIG. 4*b* shows the interior vent designed to be used with the invention without vertical support struts.

FIG. 4*a* shows a roof ventilator constructed in accordance with the present invention in a two-piece assembly in an exploded view. The ventilator 70 includes a contoured cover member 72 containing a vent 74 with openings 76. Openings 76 are preferably of a louvered configuration although they may be any other shape or size of opening as discussed hereinabove. Nailing flanges 78 include openings 80 for nailing through to the roof to secure the vent. Nailing flanges 78 may also be made of tabs rather than an entire flange. Attached to the underneath side of the contoured cover member 72 is a vent 82 including openings 84 and vertical strut support members 86. A longitudinally extending portion 88 includes nailing holes 90 for receiving any type of fastening means, preferably nails. Other fastening means, such as rivets, or poppits may be used in place of nails. In the embodiment shown in FIG. 4*a*, vertical support struts 86 are included, although they may be deleted as shown in FIG. 4*b*. The inner vent of FIG. 4*b* is intended to be utilized with the contoured cover member shown as 72 in FIG. 4*a*. For simplicity of drawing, the contoured cover member is not shown. The vent 92 of FIG. 4*b* includes openings 94, a longitudinally extending portion 96 and nailing holes 98.

Further in accordance with the present invention, FIG. 5*a* shows a ventilator 100 with a contoured cover member 102 having louvered openings 104. Again, the openings may be of any configuration. Nailing flange 106 is located at the edge of cover member 102, as well as the nailing tabs or flange 108. FIG. 5*a* does not include any interior support structures as the vent is of such a shape that it may be designed to have a load capability to withstand heavy snow which may rest thereon during the Winter. FIG. 5*b* illustrates essentially the same vent, but also includes a support member 110 to give added strength in the event that such strength may be needed.

FIG. 6 illustrates a roof ventilator 120 in place on a roof 122. Ventilator 120 is placed over shingles 124 and under the uphill shingle 126 and is secured by nails through nailing tabs 128 and a nailing flange (not shown).

All of the above-described ventilators may be made of roll formed or stamped aluminum or any other metal, or may be injection molded or extruded plastic, such as polypropylene, nylon, thermoplastics or any other suitable material of construction. Between about 1 and 20 louvers are preferable, although a similar number of openings may be present. The louvers may be up to 12 inches long, depending upon the application. For the lateral configuration of the openings, there is preferably between about 4 and 20 openings, although any number may be used as desirable for a particular application.

While the best mode for constructing the invention has been herein described in detail, those familiar with the art to which this invention relates will recognize various alternative ways of carrying out the invention as defined by the following claims.

What is claimed is:

1. A roof ridge ventilator for placement on substantially one side of a roof ridge peak in the recirculation region of a roof, comprising:

a contoured, substantially rounded cover member including a vent therein, said vent having a plurality of openings to allow circulating air to pass therethrough from a ventilation opening in the roof to which it is attached, said vent being located in the cover member at a position further down the roof from said ventilation opening and lower than said ventilation opening whereby rain is substantially prevented from entering the attic;

an attachment means for securing the contoured cover member to the roof, and said ventilator being only attached at one side to the roof ridge peak and at the other side to one side of the roof ridge peak in the recirculation zone so that the net free area of the ventilator may be maximized while infiltration of foreign matter through the ventilator into the attic is minimized.

2. The ventilator of claim 1, wherein said plurality of openings includes a plurality of louvered openings.

3. The ventilator of claim 1, wherein said ventilator is made of roll formed or stamped metal.

4. The ventilator of claim 1, wherein said ventilator is formed of injection molded plastic.

5. The ventilator of claim 1, wherein said ventilator is formed of extruded plastic.

6. The ventilator of claim 1, wherein said attachment means includes a plurality of nailing tabs and a nailing flange.

7. The ventilator of claim 1, further comprising strut support posts attached to the underside of the contoured cover member for adding load capability to the ventilator.

8. The ventilator of claim 1, wherein said cover member includes a cover member having a length from about 1 to about 10 feet long.

9. The ventilator of claim 2, wherein said louvered openings include between about 1 and 20 openings longitudinally, each opening being about 12 inches long.

10. The ventilator of claim 2, wherein there are from about 4 to about 20 louvered openings latitudinally.

11. The ventilator of claim 1, further comprising weepage openings on the downwardly facing bottom portion of the ventilator to allow any collected fluids to flow therethrough.

12. A roof ridge ventilator designed for placement on substantially one side of a roof ridge peak in the recirculation region of a roof, comprising:

a contoured, substantially rounded cover member including a vent therein, said vent having a plurality of openings to allow circulating air to pass therethrough from a ventilation opening in the roof to which it is attached;

at least one interior vent located underneath the contoured cover member with a plurality of openings therein;

an attachment means for securing the cover member to the roof, said ventilator being only attached at one side to the roof ridge peak and at the other side to one side of the roof ridge peak in the recirculation zone so that the net free area of the ventilator may be maximized while infiltration of foreign matter through the ventilator into the attic is minimized.

13. The ventilator of claim 12, wherein said interior vent is formed from an extending portion of the contoured cover member, which is then assembled by folding back and underneath the contoured cover member.

14. The ventilator of claim 12, wherein said interior vent includes at least one vented structural wall having louvered openings therein.

15. The ventilator of claim 14, wherein said at least one vented structural wall includes two vented walls with openings therein.

16. The ventilator of claim 15, wherein said two vented walls form an inverted V-shaped configuration underneath the cover member.

17. The ventilator of claim 15, wherein said two vented walls include a V-shaped configuration underneath the cover member.

18. The ventilator of claim 12, wherein said plurality of openings includes a pluralities of louvered openings.

19. The ventilator of claim 12, wherein said ventilator is made of roll formed or stamped metal.

20. The ventilator of claim 12, wherein said ventilator is formed of injection molded plastic.

21. The ventilator of claim 12, wherein said ventilator is formed of extruded plastic.

22. The ventilator of claim 12, wherein said attachment means includes a plurality of nailing tabs and a nailing flange.

23. The ventilator of claim 12, further comprising strut support posts between the interior vent, and attached to the underside of the contoured cover member for adding load capability to the ventilator.

24. The ventilator of claim 12, wherein said cover member includes a cover member having a length from about 1 to about 10 feet long.

25. The ventilator of claim 13, wherein said louvered openings include between about 1 and 20 openings longitudinally, each opening being about 12 inches long.

26. The ventilator of claim 13, wherein there are from about 4 to about 20 louvered openings latitudinally.

27. The ventilator of claim 13, further comprising weepage openings on the downwardly facing bottom portion of the ventilator to allow any collected fluids to flow therethrough.

28. The ventilator of claim 12, further comprising an air foil mounted in such a way as to further draw the air over the vent to increase the area of recirculation and to create a calm air region around the vent, thereby lower the turbulence around the vent.

29. The ventilator of claim 12, wherein said at least one interior vent includes a foot to allow the interior vent to conform to the roof face.

30. An improved roof ventilator, comprising:

a contoured, substantially rounded cover member including a vent therein having a plurality of louvered openings, said ventilator being solely placed on substantially one side of a pitched roof in the recirculation region of the roof, said cover member being formed of aluminum metal sheet;

an interior vent including two vent walls formed in an inverted V-shaped configuration, both of said vent walls including louvered openings therein to deflect air flow, said vent walls being connected at the bottom of the contoured cover member;

a foot attached to one of the vent walls to allow the interior vent to conform to the roof face;

said interior vent being connected to the underside of the cover member to supply rigidity and load capability;

said cover member and interior vent being formed of a single piece of aluminum sheet, and assembled by bending the interior vent portion back underneath the contoured cover member;

a plurality of nailing tabs and a nailing flange being formed from the aluminum sheet and contiguous with the cover member for receiving attachment means for securing the ventilator to the roof; and weepage openings located on the downwardly facing bottom portion of the ventilator for allowing collected fluids to flow therethrough.

* * * * *